US005609480A

United States Patent [19]

Boyd

[11] Patent Number: 5,609,480

[45] Date of Patent: Mar. 11, 1997

[54] CANDLE SNUFFER

[76] Inventor: Jim K. Boyd, 1608 N. D. St., Midland, Tex. 79701

[21] Appl. No.: 572,010

[22] Filed: Dec. 14, 1995

[51] Int. Cl.[6] ..... F23Q 25/00

[52] U.S. Cl. ..... 431/144

[58] Field of Search ..... 431/144, 146

[56] References Cited

U.S. PATENT DOCUMENTS

| | | | |
|---|---|---|---|
| 921,323 | 5/1909 | White | 431/144 |
| 1,740,623 | 12/1929 | Payne | 431/144 |
| 1,822,652 | 9/1931 | Gluckert | 431/144 |
| 1,936,691 | 11/1933 | Soss | 431/144 |
| 3,775,037 | 11/1973 | Sande | 431/144 |

*Primary Examiner*—Carroll B. Dority
*Attorney, Agent, or Firm*—Joseph H. McGlynn

[57] ABSTRACT

A transparent glass or ceramic shroud that is of a proper size for placing onto the top of a burning candle and once in place will eliminate any new supply of air to keep the candle burning. The shroud is transparent so a user can see the wick through the shroud and will not, therefore, bend over the wick, which will make it difficult to relight the candle. A protective ring is placed around the open end of the shroud which is removable so cleaning the shroud is easier. Also, a ring of non-heat conducting material may be placed between the ring and the shroud to protect the user's fingers.

2 Claims, 1 Drawing Sheet

CANDLE SNUFFER

BACKGROUND OF THE INVENTION

This invention relates, in general, to a candle extinguisher, and, in particular, to a simple extinguisher that will put out the candle without bending the wick.

DESCRIPTION OF THE PRIOR ART

In the prior art various types of candle extinguishers have been proposed. For example, U.S. Pat. No. 921,323 discloses an extinguisher on a long handle which has a taper holder that can be used for lighting candles. U.S. Pat. No. 1,822,652 discloses a candle extinguisher having a handle and a tapered cover which cuts off the supply of air to support the burning of the wick. U.S. Pat. No. 1,936,691 discloses a candle extinguisher having a flame retarding or fire proof liner. U.S. Pat. No. 3,775,037 discloses a candle extinguisher having a handle attached to a shroud of transparent material.

Although many types of candle extinguishers have been proposed in the prior art, most have been fitted with a handle in order to keep a persons hands or fingers away for the flame of the candle to avoid getting burned. This handle can sometimes present a storage problem when the candle extinguisher is not being used.

SUMMARY OF THE INVENTION

The present invention utilizes a transparent glass or ceramic shroud that is a proper size for placing onto the top of a burning candle and once in place will eliminate any new supply of air to keep the candle burning. The shroud is transparent so a user can see the wick through the shroud and will not, therefore, bend over the wick, which will make it difficult to relight the candle. A protective ring is placed around the open end of the shroud which is removable so cleaning the shroud is easier. Also, a ring of non-heat conducting material may be placed between the ring and the shroud to protect the user's fingers.

It is an object of the present invention to provide an improved candle snuffer which does not need a protective handle.

It is an object of the present invention to provide an improved candle snuffer which is easy to clean.

It is an object of the present invention to provide an improved candle snuffer which has a protective ring which is easily removed for cleaning.

These and other objects and advantages of the present invention will be fully apparent from the following description, when taken in connection with the annexed drawings.

DESCRIPTION OF THE PREFERRED EMBODIMENT

Figure 1:
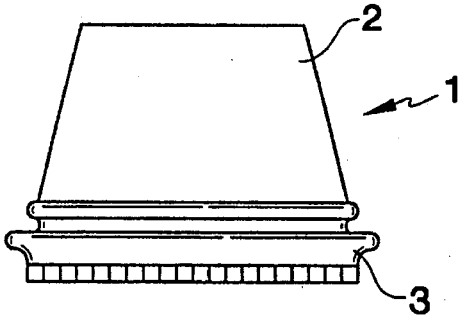
FIG. 1 is a side view of the present invention as assembled.

Referring now to the drawings in greater detail, FIG. 1 shows the candle extinguisher 1 of the present invention. The candle extinguisher comprises a shroud 2 that is preferably made of a transparent glass or ceramic material. Since it is possible to see through the shroud a user will not be as likely to bend over the wick of a candle 6 when using the candle extinguisher. If the wick is bent over when extinguishing the candle it will be difficult to light the next time the candle is lit.

Figure 2:
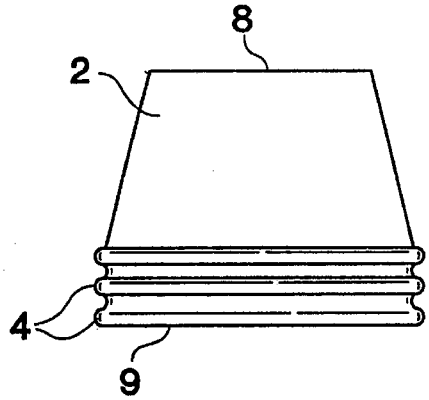
FIG. 2 is a side view of the shroud of the present invention.
Figure 3:
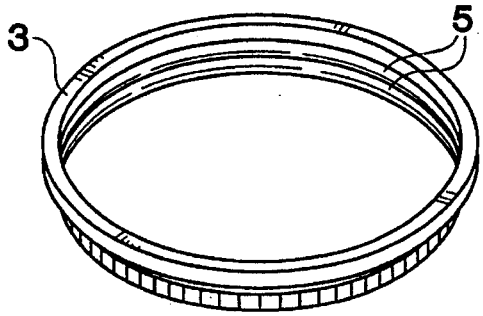
FIG. 3 is a perspective view of the protective ring of the present invention.

The shroud has a closed end 8 and an open end 9, as shown in FIG. 2, that will receive the top of the candle. Surrounding the open end of the shroud 2 are exterior screw threads 4 that will cooperate with interior screw threads 5 on the ring 3 (as shown in FIG. 3) to hold the ring on the shroud. The ring 3 should be made of metal, however other materials such as plastic could also be used. The screw threaded connection between the shroud 2 and the ring 3 will make it convenient to clean the candle extinguisher from time to time when the accumulated soot from the candle begins to darken the shroud.

Figure 4:
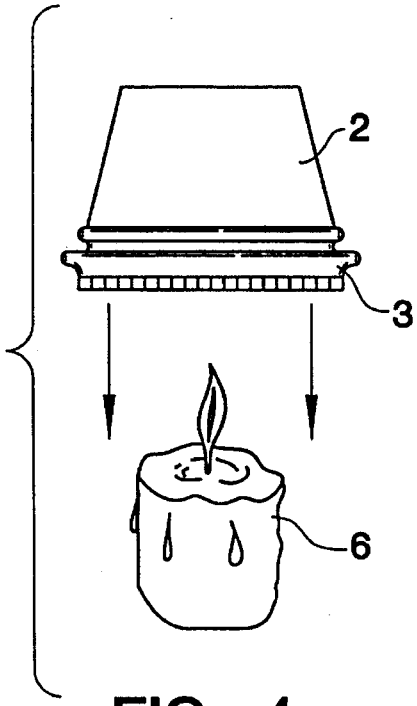
FIG. 4 is a perspective view of the present invention in position to put out a candle.

The interior diameter of the shroud should be chosen so it is approximately the same size as the outer diameter of the candle to be extinguished. This will keep the amount of air trapped inside the shroud 2 to a minimum when the shroud is placed on top of the candle (as shown in FIG. 4). When the burning flame exhausts the air trapped inside the shroud, the candle flame will go out since there will no longer be any oxygen to support combustion.

Figure 5:
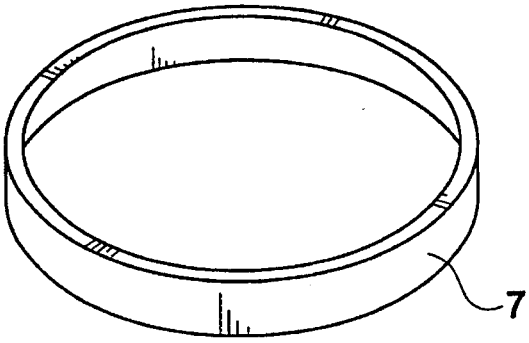
FIG. 5 is a perspective view of a ring of non-heat transferring material that can be used with the protective ring of the present invention.

If the candle extinguisher is used to put out a large amount of candles, the ring 3 may begin to heat up. In order to protect the user's fingers, a thin protective ring 7, as shown in FIG. 5, can be inserted between the ring 3 and the shroud 2. This ring should be made from a material such as, but not limited to, felt. The material can be placed on the inside of the ring 3, over the interior screw threads 5, before the ring 3 is threaded onto the shroud 2. A material like felt will conform to the shape of the screw threads 4, 5 and will, therefore, not interfere with the engagement between the ring 3 and the shroud 2. The material will prevent the outside of the ring 3 from getting too hot and burning the fingers of the user.

Although the candle snuffer and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A candle snuffer comprising:

a shroud having a closed bottom, sides, and an open top, said shroud is made from a transparent material, exterior screw threads on said sides adjacent said open top, a ring having an open bottom, sides, and an open top, said ring having interior screw threads on said sides between said open top and said open bottom, whereby said ring may be attached to said shroud by means of said interior screw threads cooperating with said exterior screw threads.

2. The candle snuffer as claimed in claim 1, wherein a ring made from a non-heat transferring material is secured between said ring and said shroud.

* * * * *